US007377808B2

(12) United States Patent
Gentry

(10) Patent No.: US 7,377,808 B2
(45) Date of Patent: May 27, 2008

(54) METHOD FOR SEALING PARTITION BUSHING CONNECTOR COAXIAL CONTACTS, ADAPTED COAXIAL CONTACT AND RESULTING CONNECTOR

(75) Inventor: John Gentry, Springfield, MO (US)

(73) Assignee: Positronic Industries, Auch Cedex (FR)

( * ) Notice: Subject to any disclaimer, the term of this patent is extended or adjusted under 35 U.S.C. 154(b) by 162 days.

(21) Appl. No.: 10/514,452

(22) PCT Filed: May 15, 2003

(86) PCT No.: PCT/FR03/01474

§ 371 (c)(1),
(2), (4) Date: Jun. 15, 2005

(87) PCT Pub. No.: WO03/098747

PCT Pub. Date: Nov. 27, 2003

(65) Prior Publication Data

US 2006/0154521 A1 Jul. 13, 2006

(30) Foreign Application Priority Data

May 15, 2002 (FR) ..... 02 05940

(51) Int. Cl.
*H01R 9/05* (2006.01)

(52) U.S. Cl. ..... 439/578; 439/936; 439/587

(58) Field of Classification Search ..... 439/589, 439/587, 736, 936; 29/856, 858, 883, 884, 29/578, 579

See application file for complete search history.

(56) References Cited

U.S. PATENT DOCUMENTS 4,231,003 A * 10/1980 Ishimaru ..... 333/33
4,480,151 A 10/1984 Dozier
4,728,301 A * 3/1988 Hemmer et al. ..... 439/578
5,281,762 A * 1/1994 Long et al. ..... 174/78
5,295,866 A * 3/1994 Kroger et al. ..... 439/589
5,344,340 A * 9/1994 Bouleau ..... 439/581
5,613,880 A * 3/1997 Wang ..... 439/620.03
5,943,770 A * 8/1999 Thenaisie et al. ..... 29/883
6,071,127 A * 6/2000 Acke et al. ..... 439/63
6,174,206 B1 * 1/2001 Yentile et al. ..... 439/638
6,300,572 B1 10/2001 McKay
6,305,947 B1 * 10/2001 Bruce ..... 439/63

FOREIGN PATENT DOCUMENTS

FR 2783105 3/2000

* cited by examiner

*Primary Examiner*—Tulsidas C. Patel
*Assistant Examiner*—Harshad C Patel
(74) *Attorney, Agent, or Firm*—Peter A. Chiabotti; Stephan A. Pendorf; Akerman Senterfitt

(57) ABSTRACT

A method for sealing coaxial contacts of a partition bushing connector to seal hermetically a connector (C) of the type which consists in inserting the contacts (300) constituting the connector to the inside of the recessed part (130) of said support (100) and in filling the free volume left between the contacts (300) and between said support (100) and said contacts (300) constituting the connector (C) with a resin (R). Said method is characterized in that it consists, prior to inserting said contacts (300) inside the recessed part (130) of the rigid support (100), in filling with a resin (R), the free volume left between the inner surface of the tube (330) and the rod (340) constituting each coaxial contact (300). The invention also concerns the adapted coaxial contact (300) for implementing the method and the connector (C) obtained by said method. The invention is applicable to fittings for hermetically sealing coaxial connectors.

8 Claims, 4 Drawing Sheets

METHOD FOR SEALING PARTITION BUSHING CONNECTOR COAXIAL CONTACTS, ADAPTED COAXIAL CONTACT AND RESULTING CONNECTOR

CROSS REFERENCE TO RELATED APPLICATION

This application is a national stage of PCT/FR03/01474 filed May 15, 2003 and is based upon French Patent Application No. 0205940, filed May 15, 2002 under the International Convention.

SCOPE OF THE INVENTION

This invention relates to the domain of partition crossing connectors and particularly adaptations for making coaxial type connectors hermetic.

DESCRIPTION OF PRIOR ART

There are many technical devices designed to function in a so-called vacuum atmosphere, for example such as components of a rocket or a space vessel, that have to operate in a space vacuum.

There are also devices or systems used on earth which cannot operate unless a vacuum atmosphere is reproduced, for example such as a particle accelerator, or a test chamber for one of the above mentioned devices design to operate in a vacuum.

For the latter applications, and particularly in order to test electronic or electrical components under a vacuum, it was necessary to create connectors between two different atmospheres, in other words between the vacuum atmosphere and the normal atmosphere, these connectors having to be fully hermetic and particularly hermetic to a vacuum, capable of crossing through a wall without communicating anything other than the electrical pulse passing through the contacts making up the connectors.

Until now, the most frequently used method for making partition crossing connectors consisted of sealing glass or ceramic on metal. With this method, each contact forming part of the connector to be made is introduced into a glass pearl that is then heated to a very high temperature such that the glass melts again, coats the said contacts and bonds to a support such that the entire connector is hermetic.

However, this method has several disadvantages.

Thus, the very high temperature necessary for remelting glass might damage the coated contact. This contact must also be made from a strongly alloyed metal or a metal that resists a particular treatment without deterioration, which considerably increases the cost price of the connector considered.

The very high temperature necessary to remelt glass limits the family of hermetic connectors to a male/male connector, considering that baking of a female contact at such a temperature would cause loss of elasticity of the reception area of the female contact, and this elasticity is necessary to maintain a good male/female contact connection. Therefore, the glass/metal sealing method is only used on pin-shaped contacts. Thus, an adaptation has to be made for the context of a partition crossing with coaxial contacts.

The said very high temperature also prevents some contacts that are too brittle from being coated, which limits the choice of the proposed hermetic connectors.

Although glass/metal sealing is fully hermetic, the seal and therefore the connector using such a manufacturing process is nevertheless very fragile.

Another manufacturing solution was developed by the applicant and described in French patent application No. 2783105, that proposes a method of sealing connector contacts in order to make a connector hermetic, that consists of introducing component contacts of the connector inside the recessed part of the support, on a connector of the type using a rigid support into which a recessed part fits and the function of which was to clamp the said connector onto the wall to be crossed, and filling the volume left free between firstly the contacts, and secondly between the said support and the said contacts, with a resin.

The connector thus made is completely hermetic without the need for any melting whatsoever. This method is particularly advantageous in that it also makes it possible to make hermetic connectors adopting female contacts in the form of bushings, unlike in prior art. Therefore the lack of melting of any material means that any type of the connector can be made hermetic.

Furthermore, the resin is a solid and strong material that can resist shocks and manipulations that could break or damage hermetic connectors made using the glass/metal sealing process.

This method is also particularly advantageous in that it consists of coating the components of a connector. The resin does not require melting but simply polymerisation, consequently when filling the recessed part of the support, it is possible to coat the components of a connector, such as insulators, without damaging them. Therefore, one advantage of this characteristic is that standard connector elements can be used, and another advantage is that the volume of the recessed part of the support to be filled can be reduced.

According to another particularly advantageous characteristic, the process according to the invention is remarkable in that it consists of preforming the inside of the recessed part of the said support in the form of projections such that the components of the connector bear on them and are adjusted to them with a clearance such that the components of the connector are positioned with respect to the said support.

One of the main needs of users of hermetic partition crossing connectors is now for coaxial connectors, and particularly coaxial connectors adapted to the so-called sub-D standard.

A coaxial connector, which by definition contains a male plug and a female plug in each contact, requires an adaptation of the sealing process, and also of the connector manufacturing process itself.

DESCRIPTION OF THE INVENTION

Starting from this state of affairs, the applicant has carried out research on a new concept for a method of sealing contacts of a coaxial type partition crossing connector, by adapting the known process according to prior art and components of the connector in order to provide a more hermetic vacuum seal, while eliminating the above mentioned disadvantages of high temperature and extreme fragility.

This research has led to the innovative design of a process for sealing contacts of a coaxial partition crossing connector in order to make a connector of the type using a rigid support into which a recessed part fits hermetic, with the function of clamping the said connector onto the wall to be crossed. The process is of the type that consists of introducing the component contacts of the connector inside the recessed part of the said support and filling the volume left free firstly between the contacts and secondly between the said support and the said contacts, using a resin, the coaxial contacts being composed of a tubular body inside which a pin is arranged axially.

The process according to the invention is remarkable in that before the component contacts of the connector are inserted inside the recessed part, it consists of filling the volume left free between the inner surface of the tube and the pin forming each coaxial contact, with a resin.

The specific features of the coaxial contacts require an appropriate sealing process. Thus, the components of the coaxial contacts are sealed with respect to each other before they are inserted and sealed inside the connector support. The use of resin guarantees good insulation of the pin with respect to the tubular body forming each coaxial contact.

Furthermore, the use of a resin prevents any damage to contacts and enables very good flexibility in genders. Therefore the connector made using this process is completely hermetic without needing any melting whatsoever. Although this advantage exists in prior art, it is particularly useful in this application related to connectors composed particularly of coaxial connectors for which the components are much more fragile and sensitive to temperature, which is the reason why connectors with coaxial contacts are rarely proposed in the range of hermetic partition crossing connectors. Furthermore, another advantage related to the use of resin lies in its flexibility of use for arranging coaxial contacts with respect to each other, thus authorising production of a sub-D type configuration.

Another purpose of the invention consists of making the coaxial contact adapted to the process according to the invention and that can implement it. This contact is of the type composed of a tubular body inside which a pin is arranged in the axial direction, and which has innovative and particularly suitable characteristics when used for a partition crossing and hermetic sealing. This contact is remarkable in that the tubular body comprises an outer female plug at its first end, and an outer male plug at its second end. Since there is no hermetic partition crossing connector, the components of the coaxial contacts forming the crossing connector are new. Thus, according to this characteristic, the tubular body has an outer male plug at its first end and an outer female plug at its second end. In prior art, a cable would have been necessary to connect these two ends, and this cable has been completely eliminated within the context of the partition crossing application.

The invention also relates to the hermetic connector obtained using such a process which is remarkable in that it is composed of several coaxial contacts filled and coated with polymerised resin, and is provided with sub-D type fool proofing means on its two faces, which will be described in further detail below with reference to the figures.

The fundamental concepts of the invention have been presented above in their most elementary form, and other details and specific features will become clearer after reading the following description with reference to the appended figures, given as a non-limitative example of at least one embodiment of a connector obtained according to the sealing process and a coaxial contact adapted according to the spirit of the invention.

DESCRIPTION OF PREFERRED EMBODIMENTS

Figure 1:
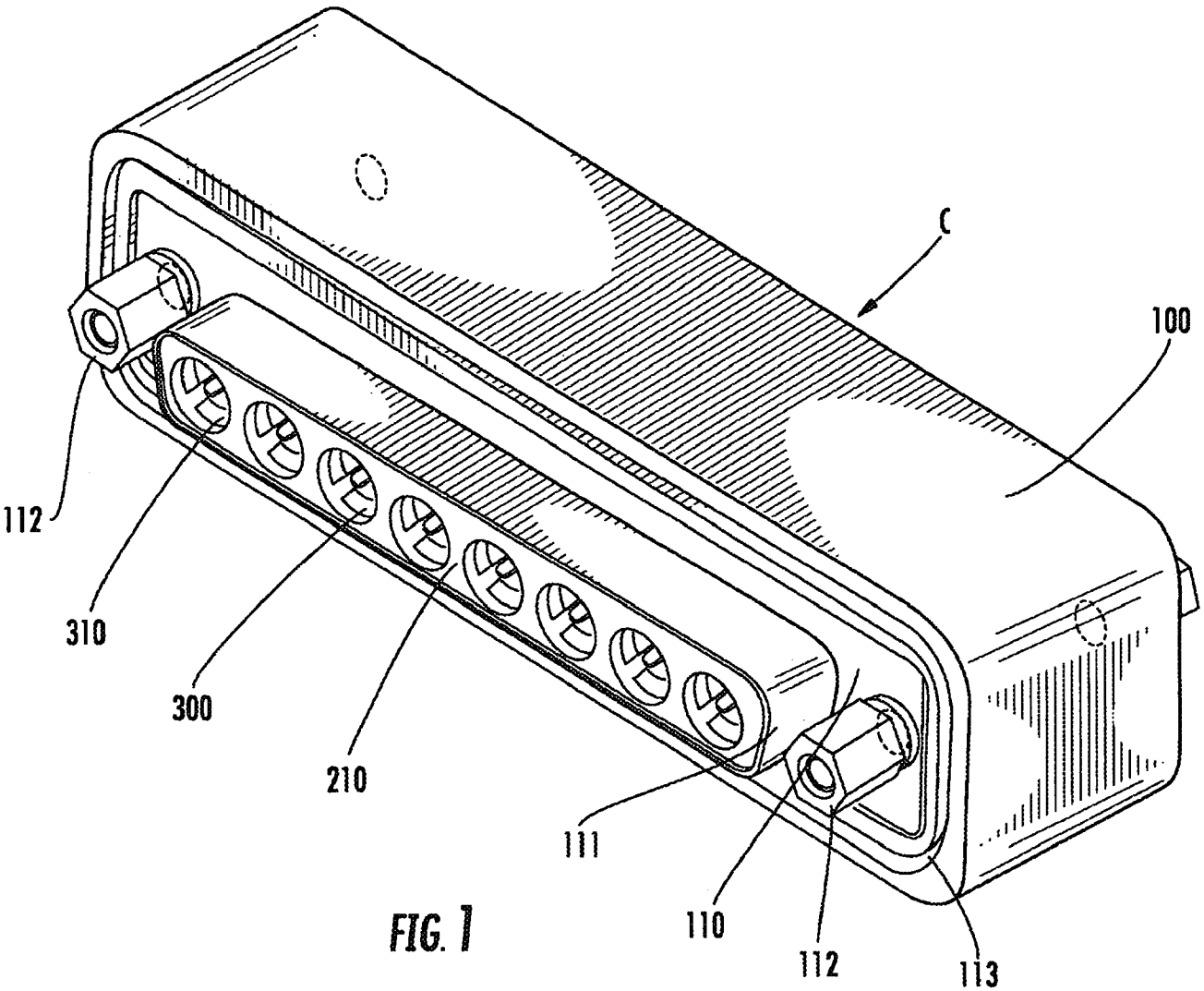
FIG. 1 shows an overall diagrammatic front perspective view of an embodiment of a hermetic "sub-D" type partition crossing connector with coaxial contacts according to the invention.

As illustrated on the drawing in FIG. 1, the connector reference C as a whole includes a support 100 on the front face 110, from which there is a projecting volume 111 according to the trapezoidal profile inherent to the so-called sub-D standard and used as a male fool proofing device in the connections. On each side of this projecting volume 111, the support 100 is provided with attachment means 112 for fixing the support onto the wall to be crossed. Similarly, the front face 110 of this support 100 is formed in a groove 113 in which a seal will be inserted in order to make the connector perfectly hermetic in the direct connection between the support 100 and the wall to be crossed.

According to the non-limitative embodiment illustrated, this support 100 includes an insulator 210 inside the projecting volume 111, the insulator being provided with eight orifices inside which there are the ends 310 of eight coaxial contacts 300, each including an inner male plug and an outer female plug.

Figure 2:
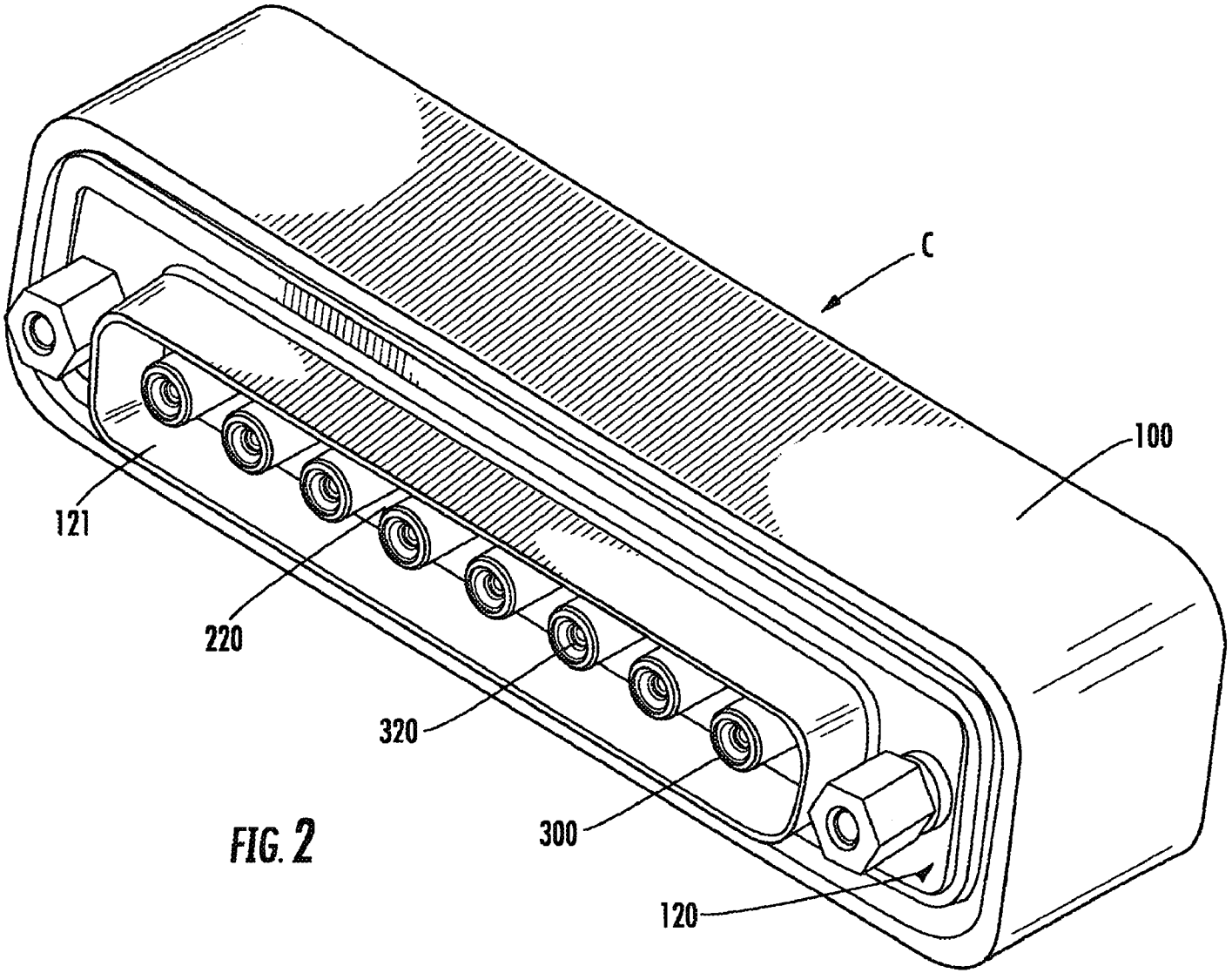
FIG. 2 is an overall diagrammatic back perspective view of the connector in FIG. 1.

The drawing in FIG. 2 illustrates the back face 120 of the connector C which, according to the sub-D standard, has a projecting collar 121 with a trapezoidal profile acting as a female fool proofing device. As for the front face, the back face 120 is provided with attachment means and a groove.

The back face 120 inside the space surrounded by the said collar 121 is provided with an insulator 220 in which there are eight orifices beyond which the ends 320 of eight coaxial contacts project. These ends 320 have an outer male plug and an inner female plug.

Figure 3:
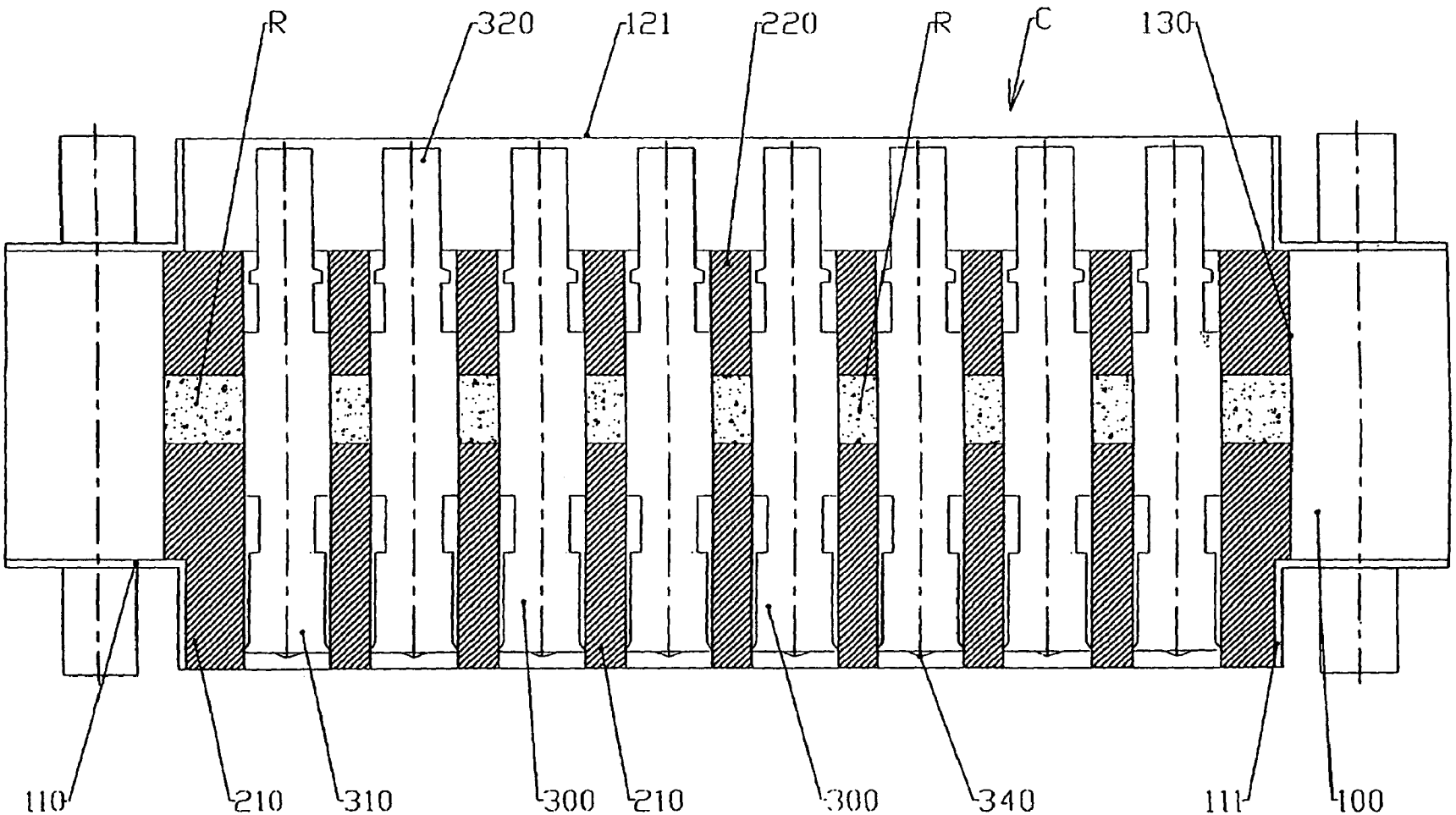
FIG. 3 is a diagrammatic sectional view through the connector in FIG. 1.

As illustrated on the drawing in FIG. 3, this connector C uses a rigid support 100 accepting a recessed part 130 and with the function of clamping the said connector C onto the wall to be crossed.

The sealing process according to the invention is based on the process consisting of inserting component contacts 300 of the connector C inside the recessed part 130 of the said support 100 and filling the volume left free between firstly the contacts 300, and secondly between the said support 100 and the said contacts 300 using a resin R. In the context of the invention, the said contacts 300 are coaxial contacts composed of a tubular body 330 inside which a pin 340 is arranged axially.

According to the invention, the coaxial contacts 300 forming the connector C were sealed before they were inserted inside the recessed part, by filling the volume left free between the inner surface of the tube 330 and the pin 340 forming each coaxial contact, with a resin R.

Figure 4:
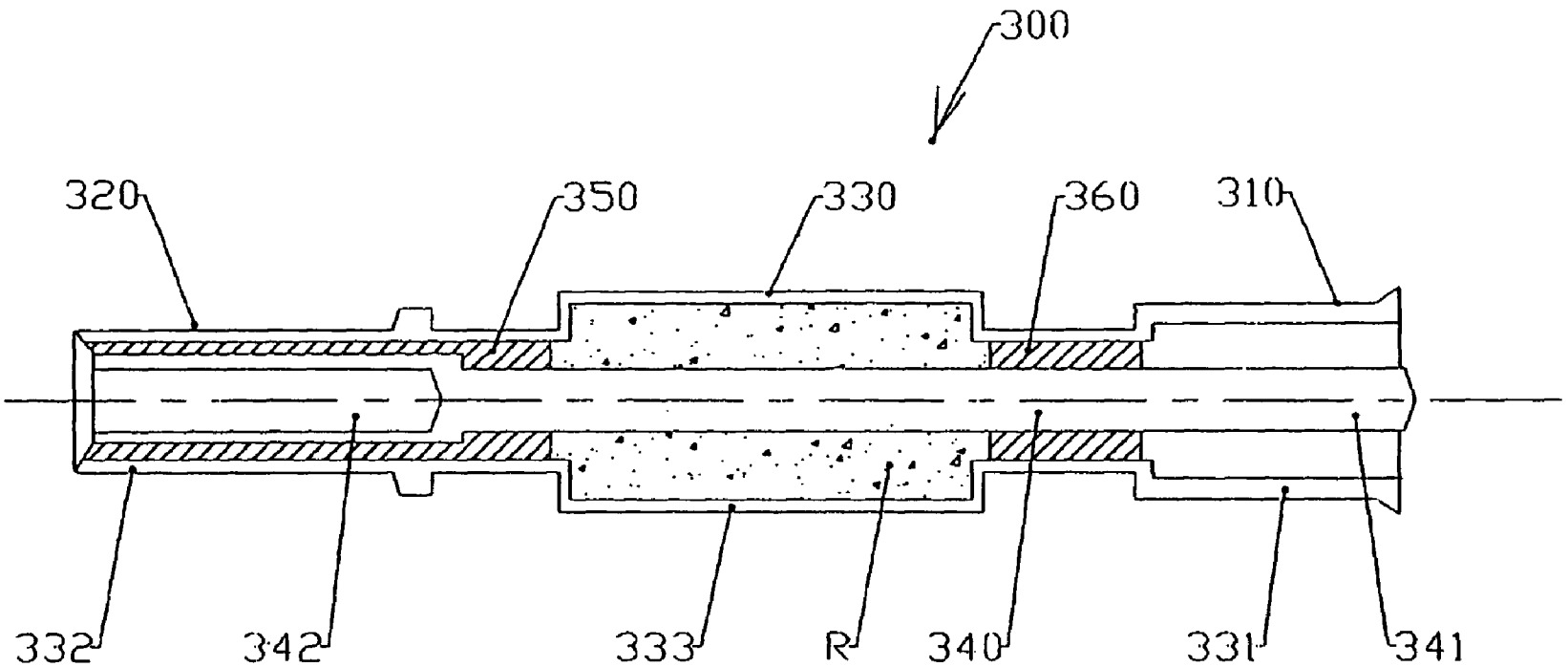
FIG. 4 is a detailed diagrammatic sectional view through an embodiment of a coaxial contact according to the invention.

According to the embodiment illustrated in FIG. 4, the tubular body 330 comprises an outer female plug 331 at a first end 310, and an outer male plug 332 at a second end 320, so that the coaxial contact is adapted to the partition crossing.

Furthermore, the said coaxial pin 340 forms a male plug 341 at a first end 310, and an inner female plug 342 at its second end 320.

According to a particularly advantageous embodiment very much simplifying the manufacture of coaxial contacts for partition crossing, the said coaxial pin 340 is made in a single part.

According to one particularly advantageous characteristic of this contact 300, the tubular body 330 has a diameter at its central part 333 greater than the diameter at its ends 331 and 332. This specific feature has the advantage that it compensates for the conductivity of the resin R by increasing the distance between walls not insulated by insulation and creates an outer and inner shoulder onto which the resin can bond for filling and for coating.

According to the illustrated embodiment, the insulating materials 350 and 360 maintain insulation between the pin 340 and the inside surface of the tube 330, and keep them coaxial.

A coaxial contact is made and filled as follows:

The inner female plug 342 has an insulating material 350 at one end of the pin 340.

This insulated plug is inserted into the end of the tubular body 330 in which there is the outer male plug 332.

The central part 333 is filled with a resin R that is polymerised.

A second insulating material 360 is then placed along the pin 340.

Thus, the volume left free between the different insulating materials 350 and 360 inside the contact is filled with a resin R.

According to one preferred embodiment, although the pin is made in a single piece, the said tubular body 330 is composed of a first part composed of one end defining the outer male plug 332 associated with the central part 333, and a second part defining the outer female plug 331, the two parts being connected by crimping.

Once the individual coaxial contacts have been made hermetic, they are integrated in the sealing process according to prior art, namely:

fabrication of the support 100 positioning of the central insulating material 220 in the support, positioning of contacts inside the orifices in the insulating material, first coating with a thin coat of resin in order to seal the insulating material 220 to the support 100, wait for 24 hours, second coat of resin on this side of the connector, wait for 24 hours, positioning of the second insulating material 210, put the fool proofing devices 111 and 121 into place.

According to one preferred but non-limitative embodiment of the invention, the resin is a polyurethane epoxy type resin and is more generally a multiple component resin.

It will be understood that the process for sealing coaxial contacts of a partition crossing connector and the connector thus obtained that have just been described above and shown in the diagrams, have been presented to illustrate the description rather than to limit it. Obviously, various arrangements, modifications and improvements could be made to the above example, without departing from the scope of the invention as defined in the claims. Obviously, the method of manufacturing hermetic connectors according to the invention is not limited to the gender nor to the number of contacts. Furthermore, the connector according to the invention can include several types of contacts, such as sub-D contacts and coaxial contacts, on the same support.

What is claimed:

1. A method of sealing coaxial component contacts (300) within a coaxial partition crossing connector to make a hermetic seal for the coaxial partition crossing connector (C) comprising:

a rigid support (100) into which a recessed part (130) fits having an attachment to clamp the connector (C) onto a wall to be crossed; and coaxial component contacts (300), which are inserted inside a recessed part (130) of the support (100), wherein the coaxial component contacts (300) are composed of a tubular body (330) inside which a pin (340) is arranged axially, the method comprising the steps of:

first, filling a first volume left free within the coaxial component contacts (300) with a resin (R), inserting the coaxial component contacts within the coaxial partition crossing connector, and secondly filling a second volume left free between the rigid support (100) and the coaxial component contacts (300), with the resin (R) to hermetically seal a first side of the connector from a second side of the connector, wherein the first volume is between the inner surface of the tube (330) and the pin (340) forming each coaxial contact (300), and is filled with the resin, before the component contacts (300) of the connector (C) are inserted inside the recessed part.

2. The method of claim 1, further comprising:

inserting an inner female plug (342) of the coaxial contacts (300) having an insulating material (350) at one end of the pin (340) into an end of the tubular body (330) in which there is the outer male plug (332);

filling a central part (333) of the coaxial contacts (300) with a resin R that is polymerized; and placing a second insulating material (360) along the pin (340) whereby allowing a volume left free between the different insulating materials (350) and (360) to be filled with the resin R.

3. A coaxial partition crossing contact (300) comprising:

a tubular body (330) inside which a pin (340) is arranged axially providing coaxial connectivity at both a first end and a second end wherein, the tubular body (330) comprises an outer female plug (331) at its first end (310), and an outer male plug (332) at its second end (320), wherein an inside volume of the coaxial partition crossing contact is filled with a resin that hermetically seals the outer female plug (331) at the first end from the outer male plug (332) at the second; and wherein, the diameter of the tubular body (330) at its central part (333) is greater than a diameter at its ends (331 and 332) to create an outer and inner shoulder onto which the resin bonds for filling and coating.

4. The coaxial contact (300) according to claim 3, wherein, the coaxial pin (340) has a male plug (341) at its first end (310) and an inner female plug (342) at its second end (320).

5. The coaxial contact (300) according to claim 4, wherein, the coaxial pin (340) is made in a single part.

6. The coaxial contact (300) according to claim 2, wherein insulating materials (350 and 360) maintain insulation between the pin (340) and the inside surface of the tubular body (330), and keep them coaxial.

7. The coaxial contact (300) according to claim 6, wherein, a volume left free between a first insulating material (350) and a second insulating material (360) inside the contact is filled with the resin (R).

8. A coaxial partition crossing connector (C) comprising:

a rigid support (100) into which a recessed part (130) fits and having an attachment that clamps the connector (C) onto a wall to be crossed; and several coaxial component contacts (300), which are inserted inside a recessed part (130) of the support (100) to provide electrical connectivity through a first side of the wall to a second side of the wall, wherein the several coaxial component contacts (300) are filled and coated with polymerized resin (R) to provide a first hermetic seal, an insulating material (220) having orifices to receive the coaxial component contacts in the rigid support (100); and a resin applied to the insulating material in the coaxial partition crossing connector on both sides of the wall to provide a second hermetic seal;

wherein the coaxial partition crossing connector is provided with sub-D type fool proofing (111 and 121) on its two faces on opposing sides of the wall.

* * * * *